United States Patent [19]

Schmidt et al.

[11] Patent Number: 4,904,565

[45] Date of Patent: Feb. 27, 1990

[54] HIGH-CONTRAST PHOTOGRAPHIC ELEMENT

[75] Inventors: Ronald J. Schmidt; Hermano P. Rocha, both of Rochester, N.Y.

[73] Assignee: Eastman Kodak Company, Rochester, N.Y.

[21] Appl. No.: 299,902

[22] Filed: Jan. 23, 1989

[51] Int. Cl.[4] ..... G03C 1/06

[52] U.S. Cl. ..... 430/264; 430/510; 430/513; 430/515; 430/517

[58] Field of Search ..... 430/264, 510, 513, 515, 430/517

[56] References Cited

U.S. PATENT DOCUMENTS 4,200,464 4/1980 Shishido et al. ..... 430/510
4,574,115 3/1986 Adachi et al. ..... 430/510
4,803,149 2/1989 Takabashi et al. ..... 430/264

FOREIGN PATENT DOCUMENTS 219010 4/1987 European Pat. Off. .
63-13033 1/1988 Japan .

*Primary Examiner*—Hoa V. Le
*Attorney, Agent, or Firm*—Paul L. Marshall

[57] ABSTRACT

A high-contrast photographic element is disclosed comprising a support having thereon in order, a layer comprising a filter dye (A), at least one silver halide emulsion layer having a gamma of at least 10, and a layer comprising a filter dye (B), which is the same as or different from dye (A), wherein filter dyes (A) and (B) absorb light in the region of the spectrum to which the silver halide emulsion layer is sensitive.

10 Claims, 1 Drawing Sheet

HIGH-CONTRAST PHOTOGRAPHIC ELEMENT

FIELD OF THE INVENTION

This invention relates to high-contrast photographic materials, such as lithographic materials often used in the graphic arts field.

BACKGROUND OF THE INVENTION

In most graphic arts reproduction processes, an image appearing to have a tone of a continuous gradation is reproduced by a collection of a large number of small dots or lines. The tone of the image is affected by both the size of the dots or lines and their density. To achieve proper reproduction of dot or line images, a graphic arts film must correctly record the relative proportions of black area and white area while achieving the proper image density.

In practice, when many graphic arts films and other photographic materials are exposed to achieve accurate reproduction of the relative proportions of white and black areas, the density of the image is too low. If the exposure is increased to achieve accurate reproduction of the image density, the proportion of black area relative to white area is too high. It would therefore be desirable to provide a high contrast photographic element for use in graphic arts that accurately reproduce the relative proportions of white and black areas of a dot or line image while achieving sufficiently high image density.

SUMMARY OF THE INVENTION

According to the present invention, a photographic material is provided comprising a filter dye (A), at least one silver halide emulsion layer having a gamma of at least 10, and a layer comprising a filter dye (B), which is the same as or different from dye (A), wherein filter dyes (A) and (B) absorb light in the region of the spectrum to which the silver halide emulsion layer is sensitive.

In a preferred embodiment, a high-contrast silver halide emulsion layer is sandwiched by the (A) and (B) dye layers.

The photographic elements of the invention provide dot or line images with accurate reproduction of the relative proportions of white and black areas while also giving high image density.

DESCRIPTION OF THE PREFERRED EMBODIMENTS

Figure 1:
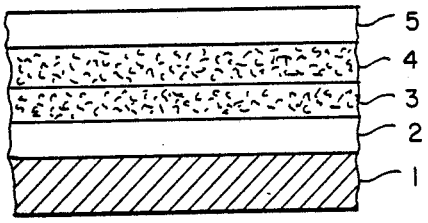
FIGS. 1 and 2 represent photographic elements with layer arrangements according to the invention.
Figure 2:
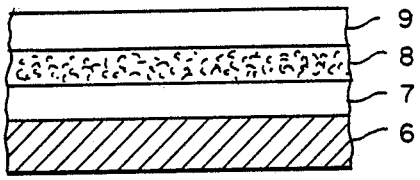

According to FIG. 1, support 1 has thereon layer 2 comprising filter dye (A), high-contrast silver halide emulsion layers 3 and 4, and layer 5 comprising filter dye (B). In a preferred embodiment, the element of the invention comprises a high-contrast silver halide emulsion layer sandwiched by two filter dye layers. Such an element is represented in FIG. 2, where support 6 has thereon layer 7 comprising filter dye (A), a high-contrast silver halide emulsion layer 8, and layer 9 comprising filter dye (B). In addition to giving high densities in the dark areas of an image while giving accurate reproduction of the relative proportions of white and black areas of halftone images, the elements of the invention also can provide the ability to control photographic speed with exposure from above or through the support, antihalation protection for exposure from above or through the support, ease of visual differentiation of the front of the element from the back through the use of different color dyes on either side of the emulsion, and a reduction in pinholes in the image.

The high-contrast silver halide emulsions useful in the present invention can be essentially any high-contrast emulsion. Such emulsions are well-known in the art. These emulsions, and preferably the element as a whole, have a $\gamma$ (gamma) of at least about 10. Gamma is a measure of contrast that is well-known in the art as describe, for example, in James, The Theory of the Photographic Process, 4th Ed., 502, MacMillan Publishing Co., 1977. These silver halide emulsions are preferably capable of forming a surface latent image. The emulsions include the high chloride emulsions conventionally employed in forming lithographic-type photographic elements, as well as silver bromide and silver bromoiodide emulsions, which are recognized in the art as capable of attaining higher photographic speeds. Generally, the halide content of the emulsions is less than about 10 mole percent iodide based on total halide.

The silver halide grains useful in the practice of the invention may be of any known configuration, including regular octahedral, cubic, or tabular grains, as described, for example, in *Research Disclosure,* Item 17643, December, 1978 [hereinafter *Research Disclosure* I], Section I, *Research Disclosure,* Item 22534, January, 1983. The silver halide grains preferably have a mean grain size of not greater than about 0.7$\mu$ and more preferably of about 0.4$\mu$ or less. As is recognized in the art, higher contrasts can be achieved by using relatively monodispersed emulsions, particularly when larger grain size emulsions are employed. As used herein, the term "monodispersed" means that the emulsion has a coefficient of variation of less than about 20%. For the highest levels of contrast, the coefficient of variation is preferably less than about 10%. As used herein, the term "coefficient of variation" is defined as 100 times the standard deviation of the grain diameter divided by the main grain diameter.

Silver halide emulsions also contain a binder or vehicle. The proportion of vehicle can be widely varied, but typically is within the range of from about 20 to 250 g/mole silver halide. The presence of excessive levels of vehicle can reduce maximum image density and consequently, contrast. Thus, for $\gamma$ values of 10 or mole, the vehicle is preferably present at a level of 250 g/mole silver halide or less. The specific vehicle materials used in the emulsion and any other layers of the photographic elements of the invention can be chosen from any of a number of well-known vehicle materials. Preferred vehicles are hydrophilic binders such as water-permeable hydrophilic colloids employed alone or in combination with extenders such as synthetic polymeric peptizers, carriers, lattices, and other binders. Such materials are more specifically described in *Research Disclosure* I, Section IX. Vehicles are usually employed with on or more hardeners, such as those described in *Research Disclosure* I, Section X.

Emulsions useful in the invention may be prepared by a variety of known techniques, including single-jet precipitation, double-jet precipitation (including continuous removal techniques), and accelerated flow rate and interrupted precipitation techniques. Such techniques are well-known in the art and do not require further description herein.

For high contrast photographic materials, high levels of photographic speed are often not required. Thus, it is not necessary to chemically sensitize the silver halide emulsions, although it is acceptable to do so. Useful chemical sensitizers include one or more middle chalcogens, sulfur, selenium, and/or tellurium. Chemical sensitization can be achieved by the use of active gelatin or by the addition of middle chalcogen sensitizers, as described in *Research Disclosure* I, Section III. Reduction and other conventional chemical sensitization techniques disclosed therein that do not unacceptably reduce contrast can also be employed.

Spectral sensitization of silver halide emulsions useful in the practice of the invention is not required, but can be accomplished using conventional spectral sensitizers, singly or in combination as illustrated by *Research Disclosure* I, Section IV. For black and white imaging, orthochromatic and panchromatic sensitizations are often preferred. Useful spectral sensitizing dyes can be any of the known cationic, anionic, or nonionic cyanine or merocyanine spectral sensitizing dyes. Such dyes are further described in Hamer, *Cyanine Dyes and Related Compounds,* 1964.

The filter dyes (A) and (B) may be essentially any dye that is useful as a photographic filter dye. These dyes include oxonols, cyanines, merocyanines, arylidenes, and the like. Such dyes are well-known in the art as disclosed, for example, in the above-referenced Hamer reference. The dyes must absorb light in the region of the spectrum to which the silver halide is sensitive and to which it will be exposed. Preferably, the dyes have absorption characteristics and are present in amounts sufficient so as to provide increased image density of an element that has been exposed and processed to achieve a halftone image having 50% black area and 50% white area (increased as compared to an element not having the (A) and (B) dye layers. The actual amount of the dyes present will vary upon the region of the spectrum to which the silver halide is sensitive and the absorption characteristics of the particular dyes; however, the filter dyes in the unprocessed element are preferably present in an amount so as to have an absorbance density of at least 0.10 density units in the region of the spectrum where the silver halide emulsion is sensitive and is to be exposed.

The filter dyes (A) and (B) may be diffusible or non-diffusible, but are preferably solubilizable during photographic processing for decolorization and/or removal. Water soluble dyes may be used for this purpose. Such dyes are preferably incorporated in the photographic element with a mordant to prevent dye wandering prior to photographic processing. Useful dyes include the pyrazolone oxonol dyes of U.S. Pat. No. 2,274,782, the solubilized diaryl azo dyes of U.S. Pat. No. 2,956,879, the solubilized styryl and butadienyl dyes of U.S. Pat. Nos. 3,423,207 and 3,384,487, the merocyanine dyes of U.S. Pat. No. 2,527,583, the merocyanine and oxonol dyes of U.S. Pat. Nos. 3,486,897, 3,652,284, and 3,718,472, the enamino hemioxonol dyes of U.S. Pat. No. 3,976,661, as well as ultraviolet absorbers, such as the cyanomethyl sulfone-derived merocyanines of U.S. Pat. No. 3,723,154, the thiazolidones, benzotriazoles, and thiazolothiazoles of U.S. Pat. Nos. 2,739,888, 3,253,921, 3,250,617, and 2,739,971, the triazoles of U.S. Pat. No. 3,004,896, and the hemioxonols of U.S. Pat. Nos. 3,215,597, and 4,045,229. Useful mordants are described, for example, in U.S. Pat. Nos. 3,282,699, 3,455,693, 3,438,779, and 3,795,519.

In a preferred embodiment, the filter dyes (A) and (B) are solid particle dispersion filter dyes, as described in U.S. Pat. No. 4,092,168 and PCT Application Publication No. WO 88/04794, the disclosure of which are incorporated herein by reference. Such dyes can be described by the formula:

$$[D\text{-}(A)_y]\text{-}X_n \qquad (1)$$

where D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, where the dye is substantially aqueous insoluble at a pH of 6 or below and substantially aqueous soluble at a pH of 8 or above. In dyes according to formula (I), X preferably has a pKa of 4 to 11 in a 50/50 volume basis mixture of ethanol and water. The dyes according to formula (I) also preferably have a log partition coefficient (log P) of from 0 to 6 when X is in unionized form.

Solid particle dispersion dyes according to formula (I) offer the advantage of being insoluble and non-diffusible in photographic elements at coating pH's, but soluble for decolorization and/or removal at photographic processing pH's. This is especially advantageous in the photographic elements of the present invention, which have at least one filter dye (dye (A)) in an internal layer of the element on the same side of the support as the silver halide emulsion. Mordanted soluble dyes in such a layer can be difficult to remove or decolorize during photographic processing and unmordanted soluble dyes wander to other layers of the element, adversely affecting the sensitometric properties of the emulsion layer(s).

Examples of filter dyes according to formula (I) include the following:

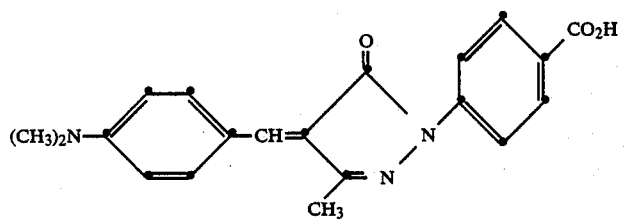

(1)

-continued (2)

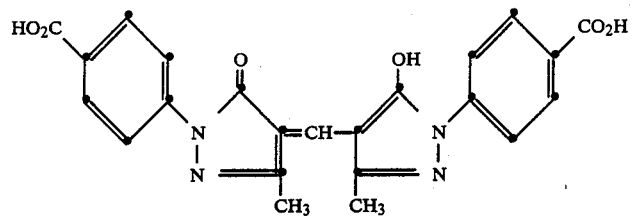

(3)

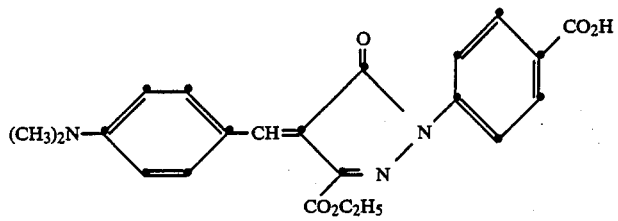

(4)

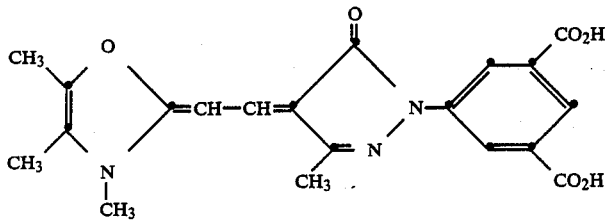

(5)

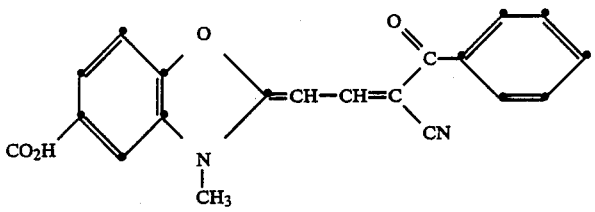

(6)

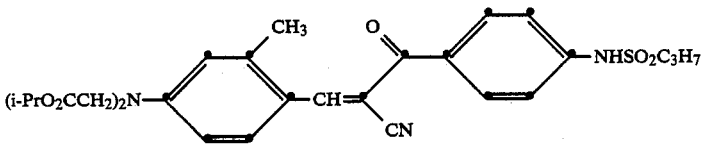

Other dyes according to formula (I) are described in the above-referenced U.S. Pat. No. 4,092,168 and WO 88/04794.

In addition to the components of the photographic emulsions and other hydrophilic colloid layers described above, other conventional element addenda and layers compatible with obtaining relatively high contrast images can be present. For example, the photographic element of the invention can contain developing agents, development modifiers, plasticizers and lubricants, coating aids, antistatic materials, matting agents, and the like, as illustrated in *Research Disclosure* I.

The element of the invention may also contain a hydrazine compound in order to achieve high contrast. Such hydrazine compounds are known in the art, as disclosed in U.S. Pat. No. 4,650,746.

As lithographic-type photographic elements, the elements of the invention are preferably utilized (exposed and processed) as sheet films. As such, the elements preferably have low curl (i.e., less than about 40 ANSI curl units at 21° C. and 15% relative humidity, using ANSI PH 1.29–1971, which calls for matching the curl of sample strips on a template of curves of varying radii to determine the radius of curvature and reporting the value of 100/R as the degree of curl where R is the radius of curvature in inches) and high dimensional stability (humidity coefficient, defined as % change in linear dimension divided by change in percent humidity over a 15–50% relative humidity range at 21° C., of less than about 0.0015).

The element of the invention may be processed by any processing technique known to be useful for processing of elements to achieve high contrast images. The processing solutions generally contain a hydroquinone developing agent, although any known developing agent may be used. If the developing agent is incorporated in the element, the element can be processed in an activator solution, which is identical to a developing solution in composition but lacking a developing agent, as described in U.S. Pat. No. 4,385,108. Depending on the element, the developing solution can be especially adapted for producing high contrast images or it can be a conventional developing solution useful for a processing a wide variety of photographic elements. As an alternative to incorporating a hydrazine compound in the photographic element, it may also be incorporated in the processing solution. Useful developing solutions are described in J.A.C. Yule, Journal of the Franklin Institute, Vol. 239, 221-30 (1945), U.S. Pat. Nos. 2,410,690, 2,419,974, 2,419,975, 2,882,152, 2,892,715, 3,573,914, 4,022,621, 4,269,929, GB No. 1,359,444, and Stauffer, Smith, and Trivelli, Journal of the Franklin Institute, Vol. 238, 291-98 (1944).

The invention is further illustrated by the following examples.

EXAMPLES 1-6

Photographic elements were prepared having the following formats. Comparison elements had filter dyes above the silver halide emulsion and on the opposite side of the support from the silver halide emulsion. Elements of the invention had filter dyes directly above and below the silver halide emulsion.

| Examples 1-5 (comparison) | |
|---|---|
| gelatin | 484 mg/m$^2$ |
| Dye 2 | 86 mg/m$^2$ |
| AgClBr (90:10, 0.15 μm) | 3.32 g/m$^2$ |
| gelatin | 2.08 g/m$^2$ |
| hydroquinone | 129 mg/m$^2$ |
| polymer latex (for dimensional stability) | 2.08 g/m$^2$ |
| **Polyester Support** | |
| gelatin | 1.89 g/m$^2$ |
| Dye 7 | 215 mg/m$^2$ |
| Dye 8 | 98 mg/m$^2$ |
| polymer latex (for dimensional stability) | 1.88 g/m$^2$ |
| gelatin | 484 mg/m$^2$ |

| Examples 1-5 (invention) | |
|---|---|
| gelatin | 484 mg/m$^2$ |
| Dye 3 | 129 mg/m$^2$ |
| AgClBr (90:10, 0.15 μm) | 3.32 g/m$^2$ |
| gelatin | 2.08 g/m$^2$ |
| hydroquinone | 129 mg/m$^2$ |
| polymer latex (for dimensional stability) | 2.08 g/m$^2$ |
| gelatin | 980 mg/m$^2$ |
| Dye 2 | 97 mg/m$^2$ |
| polymer latex (for dimensional stability) | 980 mg/m$^2$ |
| **Polyester Support** | |

| Example 6 (comparison) | |
|---|---|
| gelatin | 484 mg/m$^2$ |
| Dye 3 | 161 mg/m$^2$ |
| AgCl (0.12 μm) | 3.32 g/m$^2$ |
| gelatin | 2.08 g/m$^2$ |
| rhodium | 3.23 g/m$^2$ |
| hydroquinone | 86 mg/m$^2$ |
| polymer latex (for dimensional stability) | 2.08 g/m$^2$ |
| **Polyester Support** | |
| gelatin | 1.89 g/m$^2$ |
| Dye 7 | 215 mg/m$^2$ |
| Dye 8 | 98 mg/m$^2$ |
| polymer latex (for dimensional stability) | 1.88 g/m$^2$ |
| gelatin | 484 mg/m$^2$ |

| Example 6 (invention): | |
|---|---|
| gelatin | 484 mg/m$^2$ |
| Dye 3 | 161 mg/m$^2$ |
| AgCl (0.12 μm) | 3.32 g/m$^2$ |
| gelatin | 2.08 g/m$^2$ |
| rhodium | 3.23 g/m$^2$ |
| hydroquinone | 86 mg/m$^2$ |
| polymer latex (for dimensional stability) | 2.08 g/m$^2$ |
| gelatin | 980 mg/m$^2$ |
| Dye 2 | 86 mg/m$^2$ |
| polymer latex (for dimensional stability) | 980 mg/m$^2$ |
| **Polyester Support** | |

Dye 7

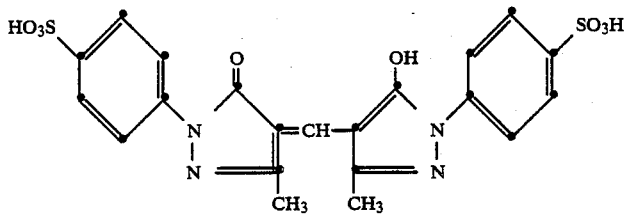

Dye 8

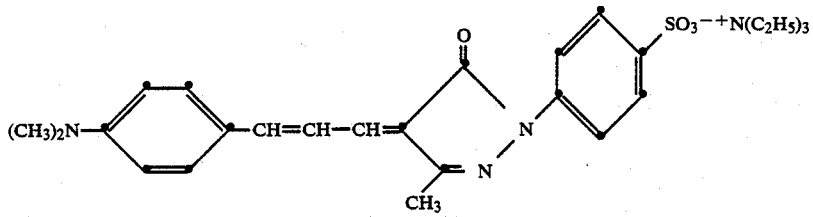

Dyes 2 and 3 were coated as solid particle dispersions as described in the Examples of WO 88/04794. The dyes in the pelloid layer on the opposite side of the support in the comparison elements were soluble dyes selected to have the same absorbtion in the region of the spectrum to which the emulsion was sensitive as the lower dye layer of the elements of the invention. Also, for Examples 1–5, Dye 2 at 86 mg/m$^2$ in the upper dye layer has the same absorbtion as Dye 3 at 129 mg/m$^2$ in the upper layer in the region of the spectrum to which the emulsion was sensitive.

The elements were exposed to a halftone image dot test pattern mask including a 50% dot area and a clear area with an exposure to produce a negative having a 50% white area from the 50% dot area of the test pattern. The elements were processed in a hydroquinone/-dimezone developer and the density of the element corresponding to the clear area of the test pattern mask was measured. This density is referred to as "dot-for-dot Dmax". Higher densities for dot-for-dot Dmax indicate better performance of the element. The results are presented in Table I.

TABLE I

| | Dot-for-Dot Dmax | |
|---|---|---|
| Example | Comparison | Invention |
| 1 | 5.2 | 5.8 |
| 2 | 4.4 | 5.8 |
| 3 | 5.0 | 5.8 |
| 4 | 5.3 | 5.9 |
| 5 | 5.2 | 5.8 |
| 6 | 5.0 | 5.9 |

The results presented in Table I show a significantly higher dot-for-dot Dmax for the elements of the invention than for the comparison elements, indicating superior dot quality.

EXAMPLES 7–12

Examples 1–6 were repeated except the exposure was reduced so that a 50% dot area test pattern resulted in a 49% white area image. This simulates a slight underexposure that might often occur in practice. The results are presented in Table II.

TABLE II

| | Dmax 1% before Dot-for-Dot | |
|---|---|---|
| Example | Comparison | Invention |
| 7 | 3.6 | 5.7 |
| 8 | 3.5 | 5.1 |
| 9 | 4.1 | 5.0 |
| 10 | 3.8 | 5.2 |
| 11 | 3.7 | 5.2 |
| 12 | 3.6 | 4.9 |

As indicated in Table II, the advantage of the elements of the invention becomes even more pronounced in situations of slight underexposure.

The invention has been described in detail with reference to preferred embodiments thereof. It should be understood, however, that variations and modifications can be made within the spirit and scope of the invention.

What is claimed is:

1. A high-contrast photographic element comprising a support having thereon in order, a layer comprising a filter dye (A), at least one silver halide emulsion layer having a gamma of at least 10, and a layer comprising a filter dye (B), which is the same as or different from dye (A), wherein filter dyes (A) and (B) absorb light in the region of the spectrum to which the silver halide emulsion layer is sensitive.

2. A high-contrast photographic element according to claim 1 wherein the element comprises a support having thereon a silver halide emulsion layer having a gamma of at least 10 sandwiched between the filter dye (A) layer and the filter dye (B) layer.

3. A high-contrast photographic element according to claim 1 or 2 wherein the filter dye (A) layer comprises a dispersion in a hydrophilic binder of solid particles of a dye having the formula:

$$[D\text{-}(A)_y]\text{-}X_n$$

wherein D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, wherein the dye is substantially aqueous insoluble at a pH of 6 or below and substantially aqueous soluble at a pH of 8 or above.

4. A high-contrast photographic element according to claim 3 wherein X has a pKa of 4 to 11 in a 50/50 volume basis mixture of ethanol and water and the dye has a log partition coefficient of from 0 to 6 when X is in unionized form.

5. A high-contrast photographic element according to claim 1 or 2 wherein the filter dye (B) layer comprises a dispersion in a hydrophilic binder of solid particles of a dye having the formula:

$$[D\text{-}(A)_y]\text{-}X_n$$

wherein D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, wherein the dye is substantially aqueous insoluble at a pH of 6 or below and substantially aqueous soluble at a pH of 8 or above.

6. A high-contrast photographic element according to claim 4 wherein X has a pKa of 4 to 11 in a 50/50 volume basis mixture of ethanol and water and the dye has a log partition coefficient of from 0 to 6 when X is in unionized form.

7. A high-contrast photographic element according to claim 1 or 2 wherein the filter dye (A) layer and the filter dye (B) layer each independently comprises a dispersion in a hydrophilic binder of solid particles of a dye having the formula:

$$[D\text{-}(A)_y]\text{-}X_n$$

wherein D is a chromophoric light-absorbing moiety, which may or may not comprise an aromatic ring if y is not 0 and which comprises an aromatic ring if y is 0, A is an aromatic ring bonded directly or indirectly to D, X is a substituent, either on A or on an aromatic ring portion of D, with an ionizable proton, y is 0 to 4, and n is 1 to 7, wherein the dye is substantially aqueous insoluble at a pH of 6 or below and substantially aqueous soluble at a pH of 8 or above.

8. A high-contrast photographic element according to claim 7 wherein X has a pKa of 4 to 11 in a 50/50 volume basis mixture of ethanol and water and the dye has a log partition coefficient of from 0 to 6 when X is in unionized form.

9. A high-contrast photographic element according to claims 1 or 2 wherein the element has a curl of less than about 40 ANSI curl units as defined herein.

10. A high-contrast photographic element according to claims 1 or 2 wherein the element has a humidity coefficient of less than about 0.0015 as defined herein.

* * * * *

UNITED STATES PATENT AND TRADEMARK OFFICE

CERTIFICATE OF CORRECTION

PATENT NO. : 4,904,565

DATED : February 27, 1990

INVENTOR(S) : R. J. Schmidt and H. P. Rocha

It is certified that error appears in the above-identified patent and that said Letters Patent is hereby corrected as shown below:

Column 10, line 55 "claim 4" should read --claim 5--.

Signed and Sealed this

Twentieth Day of August, 1991

*Attest:*

*Attesting Officer*

HARRY F. MANBECK, JR.

*Commissioner of Patents and Trademarks*